US005647618A

United States Patent [19]

Lamberth

[11] Patent Number: 5,647,618

[45] Date of Patent: Jul. 15, 1997

[54] INFANT SAFETY LATCH MECHANISM

[76] Inventor: James E. Lamberth, 7207 Carriage Hill Dr., Laurel, Md. 20707

[21] Appl. No.: 546,958

[22] Filed: Oct. 23, 1995

[51] Int. Cl.[6] ..... E05C 19/06

[52] U.S. Cl. ..... 292/19; 292/80

[58] Field of Search ..... 292/19, 20, 80, 292/87, DIG. 38

[56] References Cited

U.S. PATENT DOCUMENTS

| | | | |
|---|---|---|---|
| 328,291 | 10/1885 | Cooper | 292/19 |
| 486,227 | 11/1892 | Henry . | |
| 1,139,316 | 5/1915 | Valkenburgh | 292/19 |
| 1,152,404 | 9/1915 | Eldridge . | |
| 1,425,618 | 8/1922 | Vodicka . | |
| 1,487,522 | 3/1924 | Andrews . | |
| 1,489,375 | 4/1924 | Wentworth | 292/19 |
| 1,579,619 | 4/1926 | Kerby | 292/19 |
| 2,233,699 | 3/1941 | Gorrell | 292/1 |
| 2,759,782 | 8/1956 | Goodwin, Jr. | 312/291 |
| 2,936,189 | 5/1960 | Pearson | 292/42 |
| 3,151,901 | 10/1964 | Ahlgren | 292/124 |
| 3,519,299 | 7/1970 | Godwin | 292/175 |
| 4,139,249 | 2/1979 | Hillman | 292/87 |
| 4,286,809 | 9/1981 | Godwin | 292/54 |
| 4,378,948 | 4/1983 | Chrones | 292/19 |
| 4,715,628 | 12/1987 | Brink et al. | 292/19 |
| 4,792,165 | 12/1988 | Nishimura | 292/19 |
| 5,147,099 | 9/1992 | McLinden et al. | 292/DIG. 38 X |

FOREIGN PATENT DOCUMENTS

| | | | |
|---|---|---|---|
| 2673970 | 9/1992 | France | 292/19 |

*Primary Examiner*—Rodney M. Lindsey

*Attorney, Agent, or Firm*—Roylance, Abrams, Berdo & Goodman L.L.P.

[57] ABSTRACT

An infant safety latch mechanism designed to be mounted within the interior of an enclosure for preventing children from gaining access into the enclosure. Specifically, the latch mechanism requires an adult size hand to operate so that the enclosure cannot be opened by a young child or infant. The latch mechanism can be mounted to a wide variety of enclosures, including drawers, cabinets with sliding doors and cabinets with swinging door. The latch mechanism includes a cleat with a pair of first latching elements mounted to a first part of the enclosure, a mounting guide secured to a second part of the enclosure, and a clip with a pair of second latching elements slidably mounted to the mounting guide. The second latching elements have release arms for moving the latching elements of the clip from a latched position to an unlatched position. The difference between the release arms should be sufficiently spread apart so that an adult size hand is required to squeeze the release arms together for unlatching the clip from the cleat. The cleat can also be provided with a safety tab, which is located between the latching elements such that the safety tab must first be depressed before the latching elements of the clip can be disengaged from the latching elements of the cleat.

12 Claims, 10 Drawing Sheets

INFANT SAFETY LATCH MECHANISM

FILED OF THE INVENTION

This invention relates to a latch mechanism adapted to be coupled to the interior surfaces of an enclosure for preventing children from gaining access into the enclosure. More specifically, the latch mechanism of the present invention is designed to be installed within a conventional enclosure such as a cabinet, a drawer or the like, without modifying the exterior of the enclosure.

BACKGROUND OF THE INVENTION

As every parent knows, a child cannot be watched every minute of the day, even in their own home. In fact, children are quite often left unattended for five, ten or even fifteen minutes without any adult supervision. Due to children's curiosity, children often get into trouble when the parent or the child's caretaker is distracted for just a few minutes. Accordingly, it is important for parents, day cay care centers, baby sitters and other child caretakers to child-proof their homes for young children, especially in the one to four year old range.

One of the most common accidents for young children in the home is childhood poisoning. In fact, a large number of serious illnesses, and even fatalities, occur each year to young children due to children consuming poison household products or medicines. Many of these accidents could have been prevented by keeping these dangerous products stored in places unaccessible to young children.

In view of this problem of childhood poisonings, numerous efforts have been made to develop child-proof enclosures or latch mechanisms, which would prevent young children from opening the enclosure, and yet still allow relatively easy access by adults. Examples of some prior patented devices are disclosed in U.S. Pat. No. 1,152,404 to Eldridge; U.S. Pat. No. 2,233,699 to Gorrell, U.S. Pat. No. 2,759,782 to Goodwin; U.S. Pat. No. 3,519,299 to Goodwin; and U.S. Pat. No. 4,286,809 to Goodwin.

As mentioned in U.S. Pat. No. 3,519,299 to Goodwin and U.S. Pat. No. 4,286,809 to Goodwin, many of these prior art safety latch mechanisms are based on the differences between children's hands and their manual dexterity from that of adults. Accordingly, many prior art latch mechanisms require the hand span of an adult to effect release of the catch, and/or manual dexterity that is beyond the scope of children and yet still within the scope of adults.

However, these prior art devices suffer from many disadvantages. In particular, many of these devices are attached to the exterior surface of the enclosure, and thus are always visible. Some, like the one disclosed in U.S. Pat. No. 4,286,809 to Goodwin, even require the exterior of the enclosure to be permanently altered to accommodate the latch mechanism. This type of latch mechanism is not typically acceptable for expensive kitchen and bathroom cabinets and drawers.

Other prior art child-proof latch mechanisms are relatively expensive and some are often even difficult for adults to operate. Moreover, many of these prior art devices can only be used on certain types of enclosures. Thus, different latch mechanisms must be used for drawers than those used for cabinets. In other words, often several different types of latch mechanisms must be purchased to child-proof one's home depending upon the types of cabinets and/or drawers to be secure in the home. Moreover, many of these latch mechanisms cannot be placed in a "null" position for deactivating the latch mechanism without having disassemble or remove the latch mechanism from the enclosure.

In view of the above, it will be apparent to those skilled in the art from this disclosure that there exists a need for an improved infant safety latch mechanism which can be easily retrofitted to a wide variety of enclosures, including cabinets with swinging doors and drawers. Accordingly, this invention addresses this need in the art, along with other needs which will become apparent to those skilled in the art once given this disclosure.

SUMMARY OF THE INVENTION

Accordingly, one object of the present invention is to provide an infant safety latch mechanism which is easily installed on a wide variety of existing enclosures including cabinets with swinging and/or sliding doors as well as cabinets with drawers.

Another object of the present invention is to provide an infant safety latch mechanism which is completely concealed within the interior of the enclosure so as not to impair the external appearance of the enclosure or cabinet.

Another object of the present invention is to provide an infant safety latch mechanism which can be deactivated without having to disassemble or remove the latch mechanism from the enclosure and then capable of being readily reactivated when needed without tools.

Still another object of the present invention is to provide an infant safety latch mechanism which is relatively easy to manufacture as well as relatively inexpensive to manufacture.

Yet another object of the present invention is to provide an infant safety latch mechanism that requires no keys, memory codes or complicated manipulations to affect their release.

The foregoing objects are basically attained by providing an infant safety latch mechanism adapted to be bound within an enclosure for securing a movable member of the enclosure to a fixed member of the enclosure, the latch mechanism comprising: a cleat having a base adapted to be mounted to an interior surface of one of the members of the enclosure, and a pair of first spaced latching elements coupled to the base; a mounting guide adapted to be coupled to an interior surface of the other member of the enclosure; and a clip having a body portion movably coupled to the guide for limited movement within a predetermined range of movement, and a pair of second spaced latching elements coupled to the body portion for engaging the first latching elements to releasably couple the cleat and the clip together so that the cleat and the clip can move together relative to the guide when in a latched position.

Other objects, advantages and salient features of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring to the drawings which form part of this original disclosure.

DETAILED DESCRIPTION OF THE PREFERRED EMBODIMENT

Figure 1:
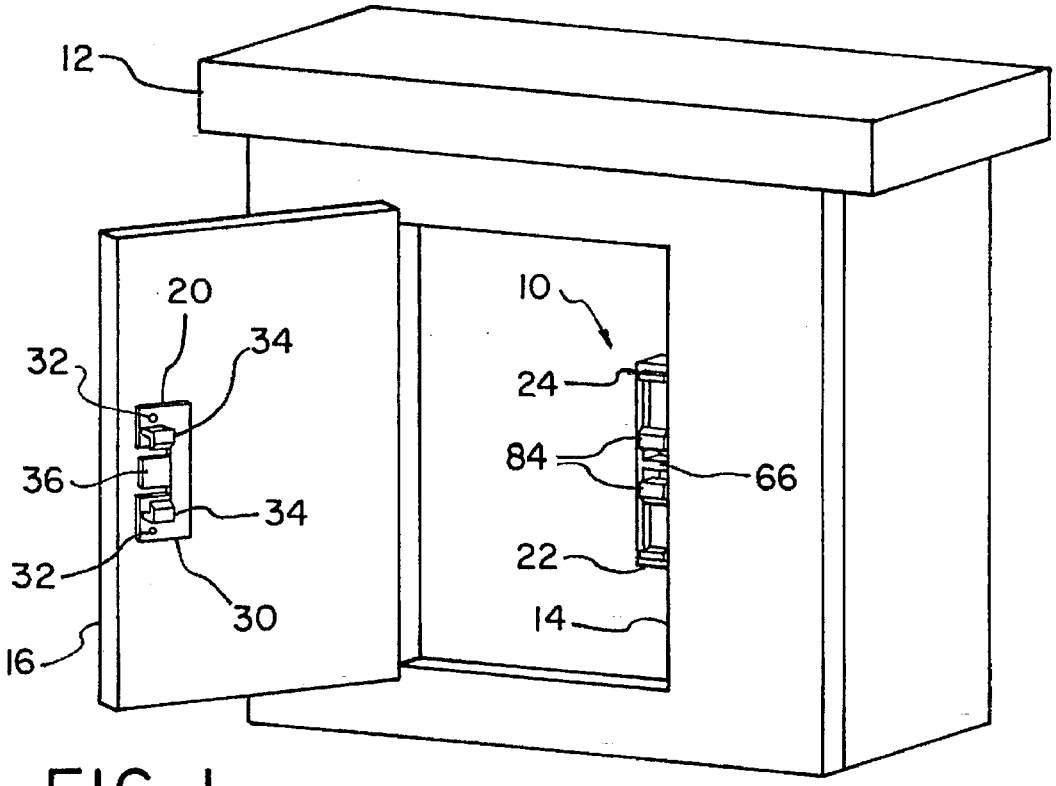
FIG. 1 is a perspective view of an infant safety latch mechanism in accordance with the present invention being installed on an enclosure for locking a pivotally mounted door.
Figure 2:
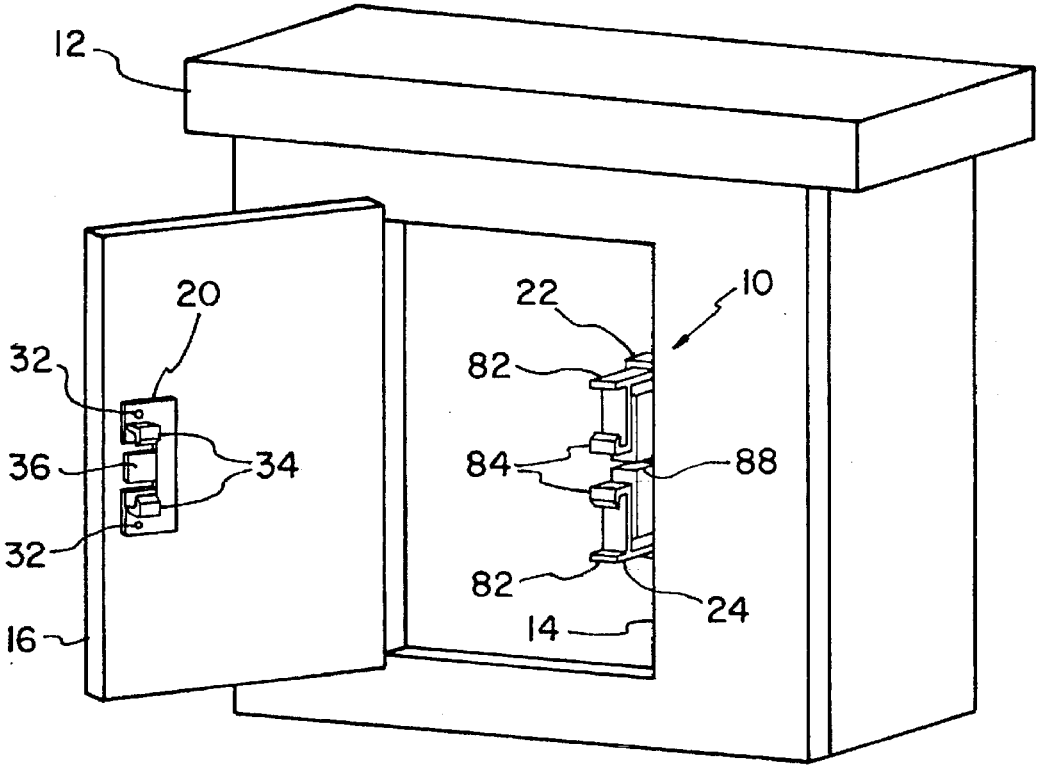
FIG. 2 is a perspective view of the infant safety latch mechanism illustrated in FIG. 1 being coupled to an enclosure, with the clip of the latch mechanism illustrated in the extended position.
Figure 3:
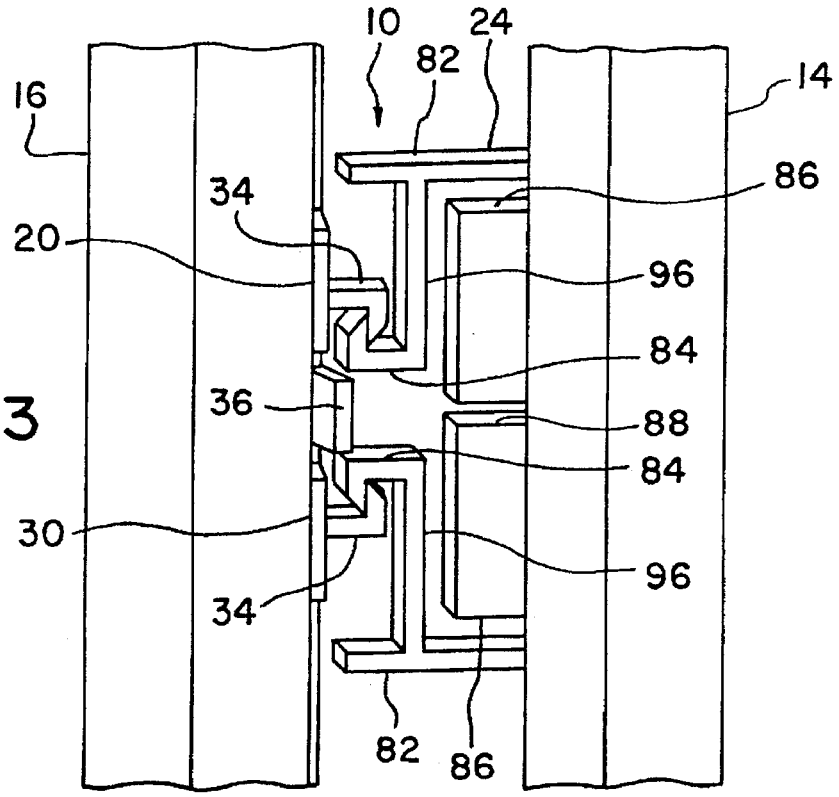
FIG. 3 is an enlarged, partial perspective view of the infant safety latch mechanism illustrated in FIGS. 1 and 2 being coupled to an enclosure, with the latch illustrated in the locked position and the door partially open for accessing the infant safety latch mechanism in accordance with the present invention.
Figure 4:
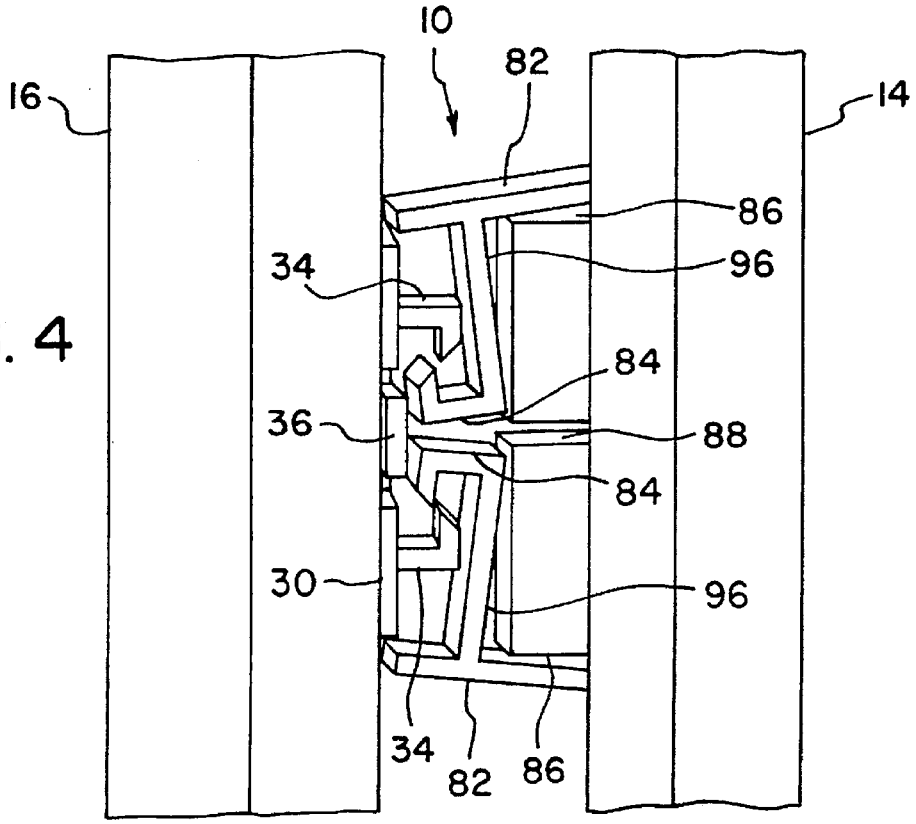
FIG. 4 is an enlarged, partial perspective view of the infant latch mechanism illustrated in FIGS. 1–3 being coupled to an enclosure, with the latch mechanism being moved to the unlatching position to permit further relative movement of the door of the enclosure relative to the remainder of the enclosure.
Figure 5:
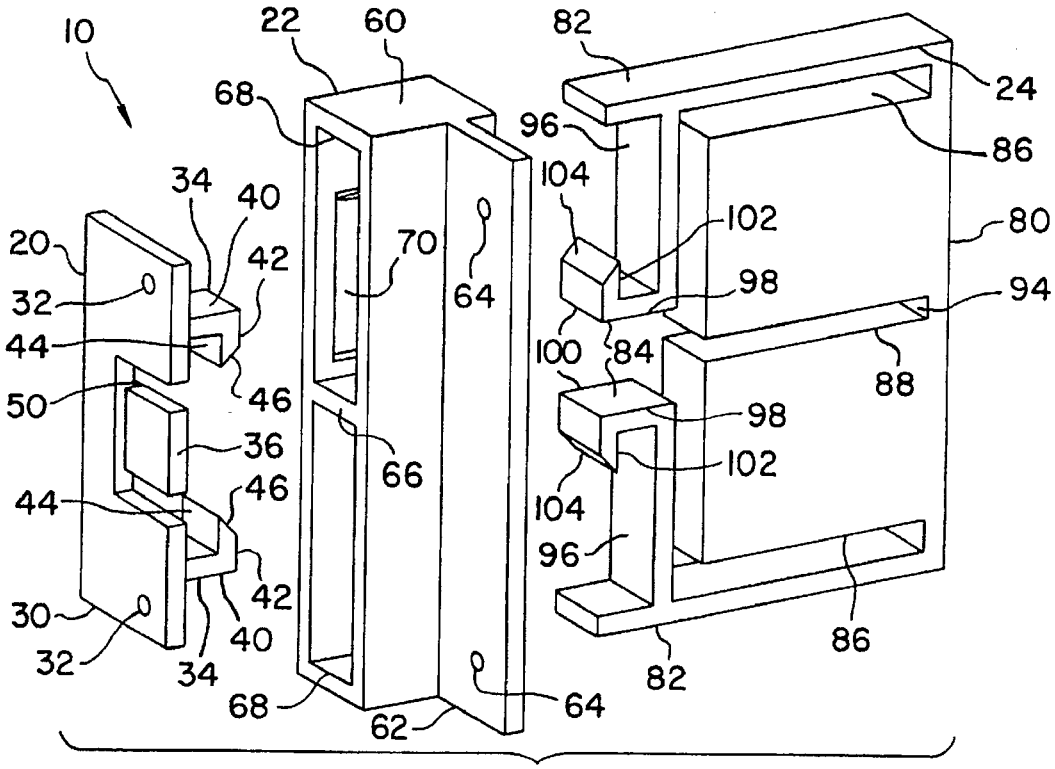
FIG. 5 is an enlarged, exploded right side perspective view of the infant safety latch mechanism illustrated in FIGS. 1–4 in accordance with the present invention.
Figure 6:
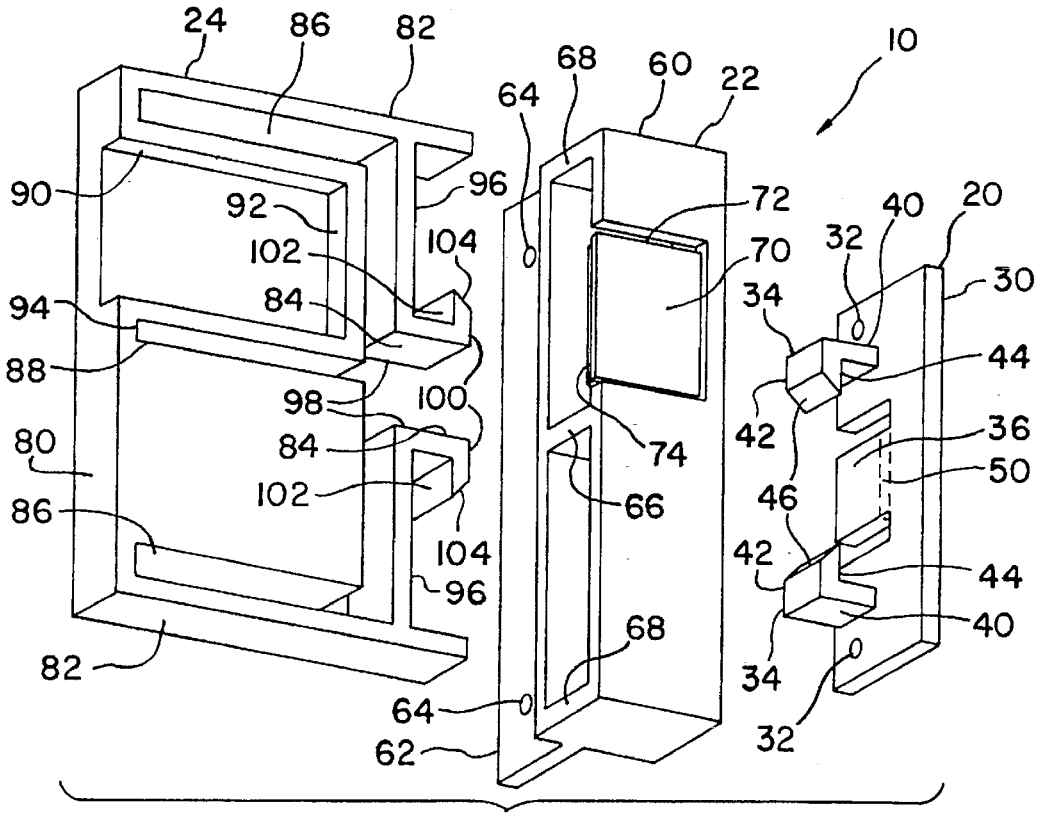
FIG. 6 is an enlarged, exploded left side perspective view of the infant safety latch mechanism illustrated in FIGS. 1–5.
Figure 7:
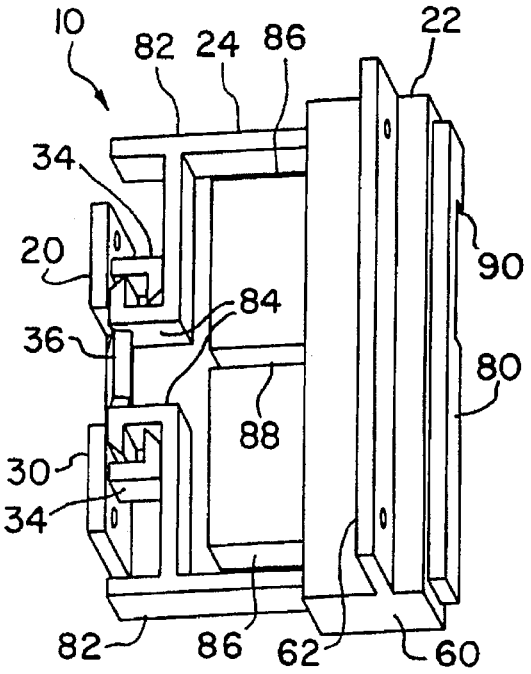
FIG. 7 is an enlarged, right side perspective view of the infant safety latch mechanism illustrated in FIGS. 1–6 shown in the latched position and with the mounting guide moved to its rearmost position.
Figure 8:
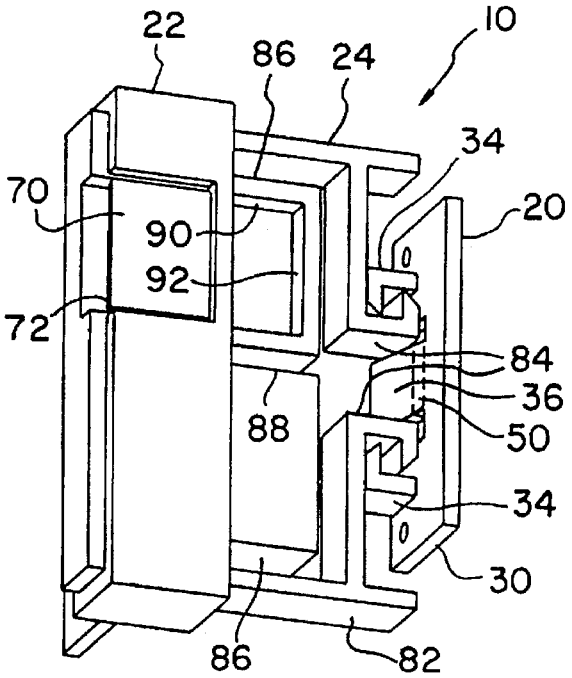
FIG. 8 is an enlarged, left side perspective view of the infant safety latch mechanism illustrated in FIGS. 1–7 shown in the latched position and with the mounting guide moved to its rearmost position.
Figure 9:
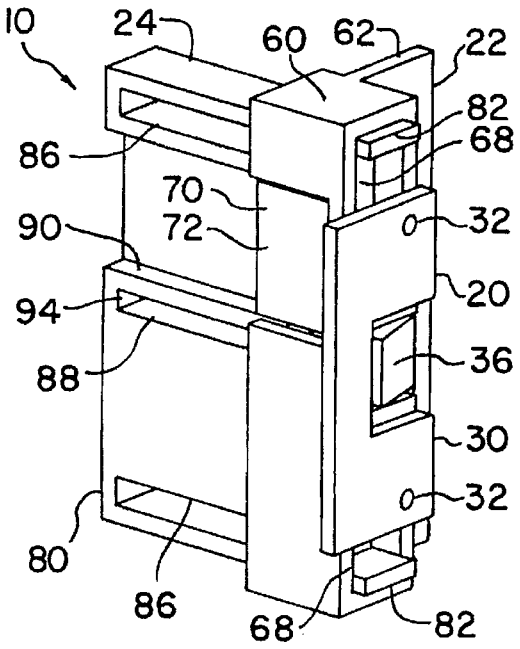
FIG. 9 is an enlarged, front perspective view of the infant safety latch mechanism illustrated in FIGS. 1–8 in the latched position and with the mounting guide moved to its foremost position.
Figure 10:
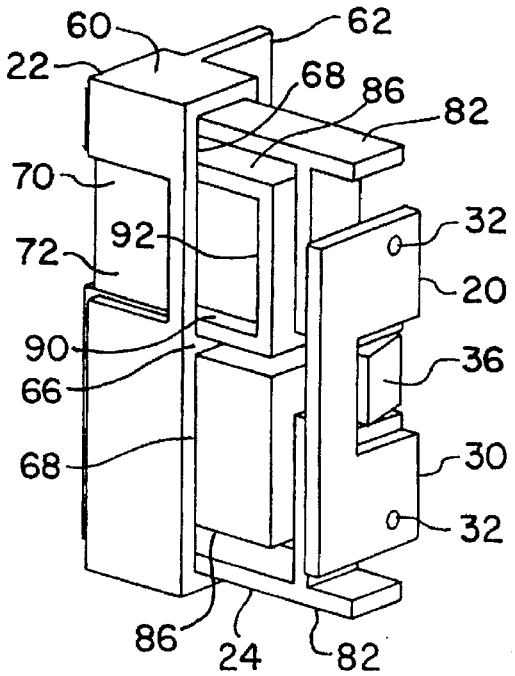
FIG. 10 is an enlarged, front perspective view of the infant safety latch mechanism illustrated in FIGS. 1–9 in its latched position, and with the mounting guide moved to its rearmost position.

Referring initially to FIGS. 1–4, an infant safety latch mechanism 10 in accordance with the present invention is illustrated as being coupled to an enclosure 12 for preventing children from gaining access to enclosure 12 and yet allowing adults to easily and quickly open enclosure 12. Latch mechanism 10 of the present invention requires an adult size hand to operate for opening the enclosure, and can be added to practically any existing enclosure with little or no modification thereto.

It will be apparent to those skilled in the art from this disclosure that although latch mechanism 10 is illustrated as being coupled to a cabinet with a swing door that latch mechanism 10 can also be mounted to any drawer, sliding panel or swinging door. Enclosure 12 for the purposes of illustrating the present invention is a conventional enclosure having a fixed member or cabinet 14 and a pivotally mounted door or movable member 16. Accordingly, enclosure 12 will not be discussed in detail herein and is only used to illustrate one example of the use of the latch mechanism of the present invention.

Latch mechanism 10 includes a cleat 20, a mounting guide 22 and a clip 24. Preferably, cleat 20, mounting guide 22 and clip 24 are each constructed of a substantially rigid plastic material with limited flexibility and resiliency, such as polyethylenes, polypropylenes or nylons. Accordingly, cleat 20, mounting guide 22 and clip 24 can each be injection molded as an integral one-piece, unitary member out of a variety of suitable plastic materials. This allows latch mechanism 10 to be manufactured using conventional equipment and at a relatively inexpensive price.

As seen in FIGS. 1–4, cleat 20 is preferably coupled to the door or movable member 16, while the mounting guide 22 is fixedly coupled to the cabinet or fixed member 14 with clip 24 being slidably coupled to mounting guide 22 for limited relative movement. Accordingly, when cleat 20 and clip 24 are in their latched position, door or movable member 16 can only be moved through a limited range of movement for accessing latch assembly 10. Clearly, this allows for latch assembly 10 to be completely hidden during normal use when the door is closed.

It will be apparent to those skilled in the art, that depending upon the construction of the enclosure, various parts of the present invention could be interchanged between the fixed member and the movable member of any enclosure. For example, a sliding panel could have the mounting guide 22 and clip 24 mounted thereon, while the fixed structure of the cabinet could have cleat 20 mounted thereon.

Figure 11:
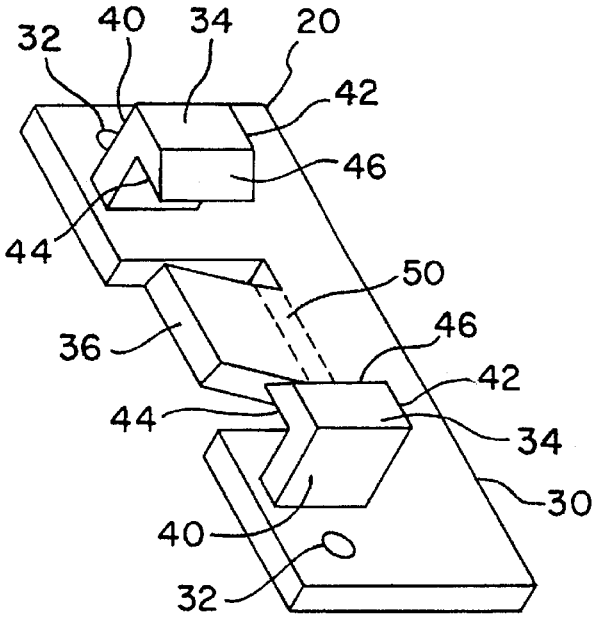
FIG. 11 is an enlarged perspective view of the cleat for the infant safety latch mechanism illustrated in FIGS. 1–10.
Figure 12:
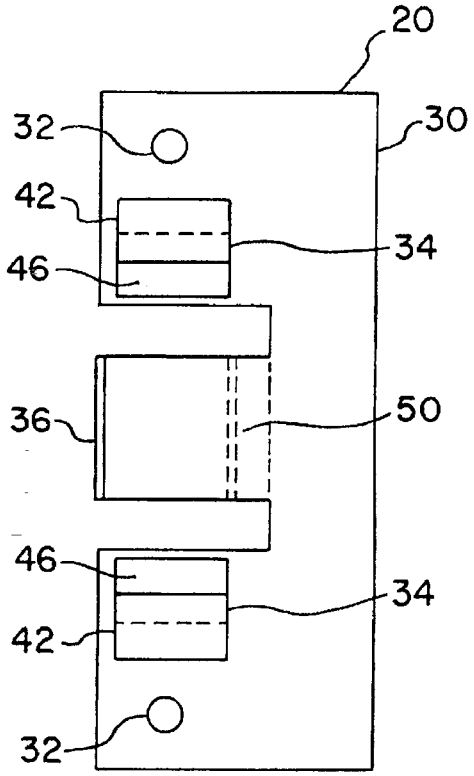
FIG. 12 is a front elevational view of the cleat illustrated in FIG. 11 for the infant safety latch mechanism illustrated in FIGS. 1–10.
Figure 13:
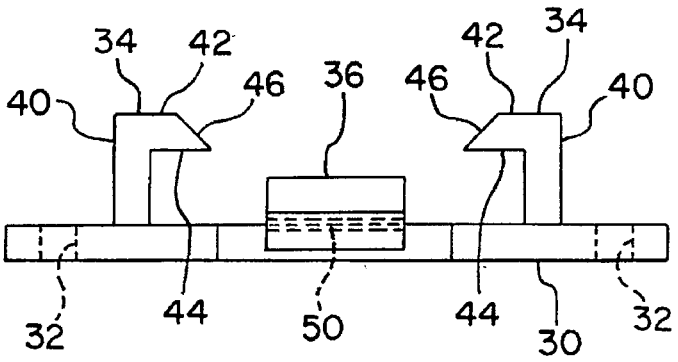
FIG. 13 is a left end elevational view of the cleat illustrated in FIGS. 11 and 12 for the infant safety latch mechanism illustrated in FIGS. 1–10.
Figure 14:
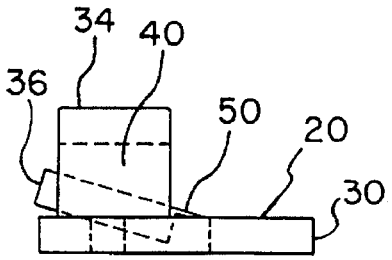
FIG. 14 is a top plan view of the cleat illustrated in FIGS. 11–13 for the infant safety latch mechanism illustrated in FIGS. 1–10.
Figure 15:
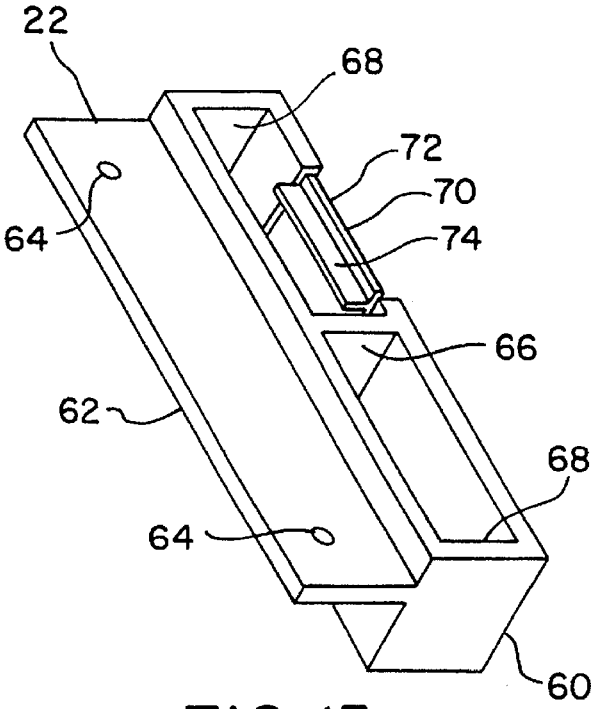
FIG. 15 is an enlarged perspective view of the mounting guide for the infant safety latch mechanism illustrated in FIGS. 1–10.
Figure 16:
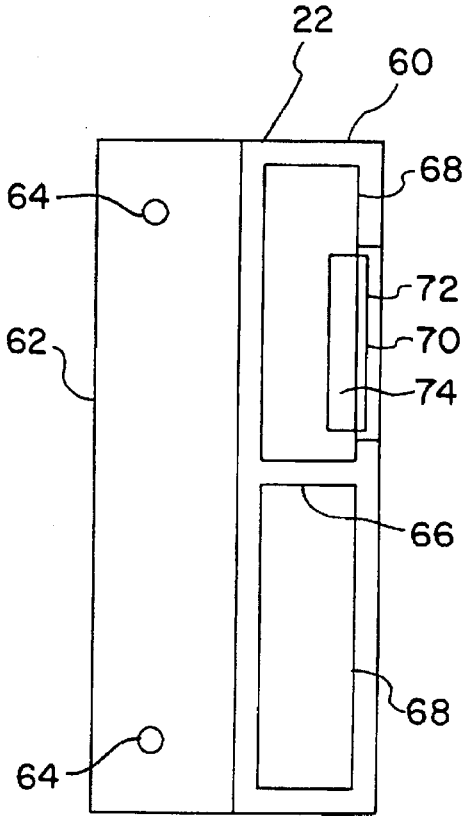
FIG. 16 is a rear elevational view of the mounting guide illustrated in FIG. 15 for the infant safety latch mechanism illustrated in FIGS. 1–10.
Figure 17:
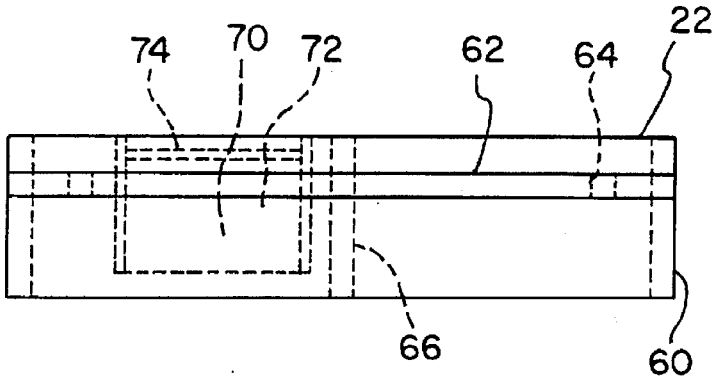
FIG. 17 is a right side elevational view of the mounting guide illustrated in FIGS. 15 and 16 for the infant safety latch mechanism illustrated in FIGS. 1–10.
Figure 18:
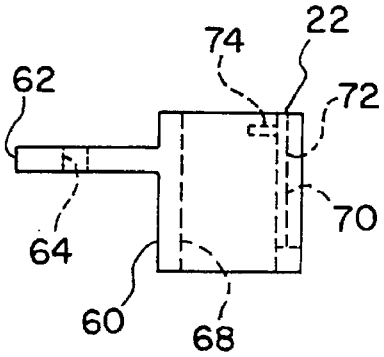
FIG. 18 is a top plan view of the mounting guide illustrated in FIGS. 15–17 for the infant safety latch mechanism illustrated in FIGS. 1–10.
Figure 19:
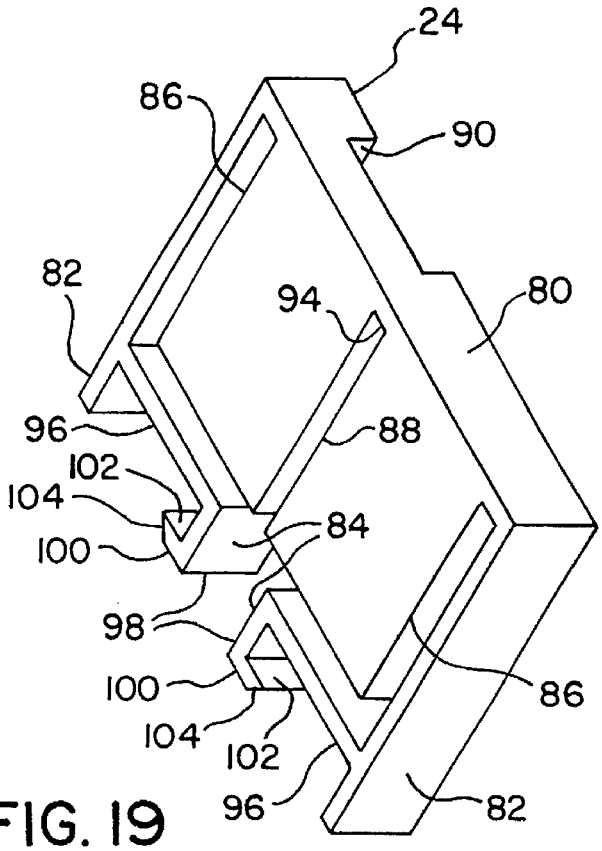
FIG. 19 is an enlarged, side perspective view of the clip for the infant safety latch mechanism illustrated in FIGS. 1–10.
Figure 20:
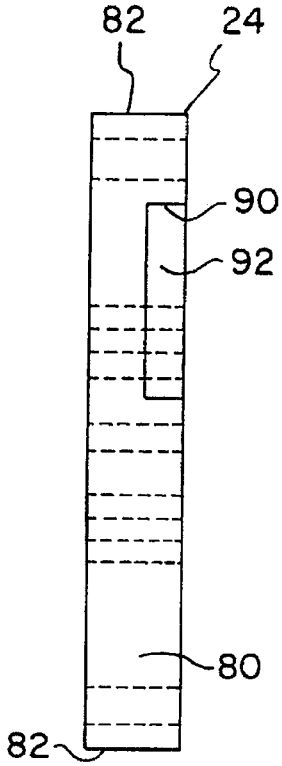
FIG. 20 is a rear elevational view of the clip illustrated in FIG. 19 for the infant safety latch mechanism illustrated in FIG. 1–10.
Figure 21:
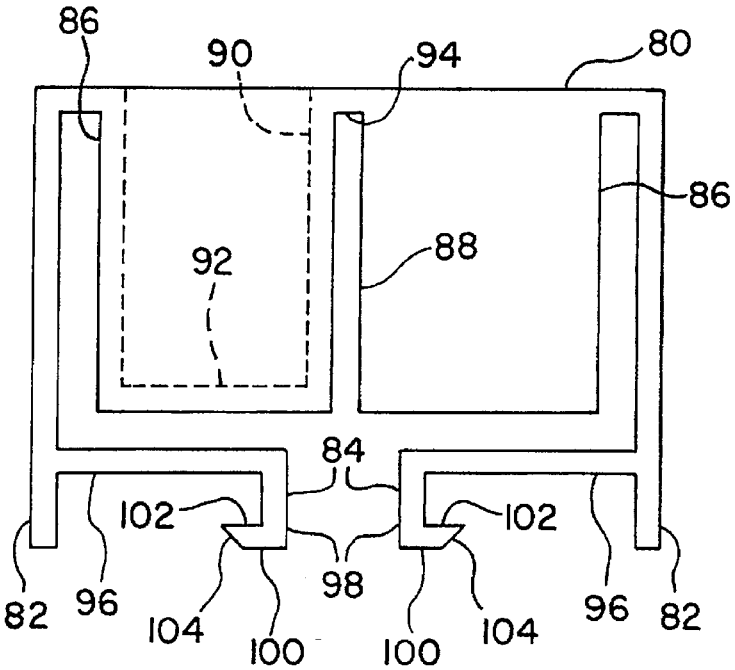
FIG. 21 is a right side elevational view of the clip illustrated in FIGS. 19 and 20 for the infant safety latch mechanism illustrated in FIGS. 1–10.
Figure 22:
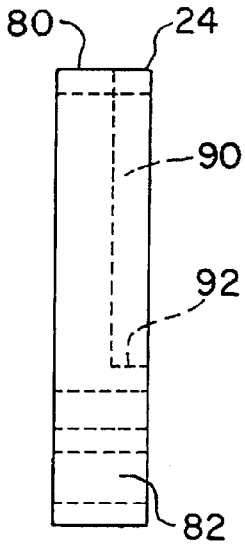
FIG. 22 is a top plan view of the clip illustrated in FIGS. 19–21 for the infant safety latch mechanism illustrated in FIGS. 1–10.
Figure 23:
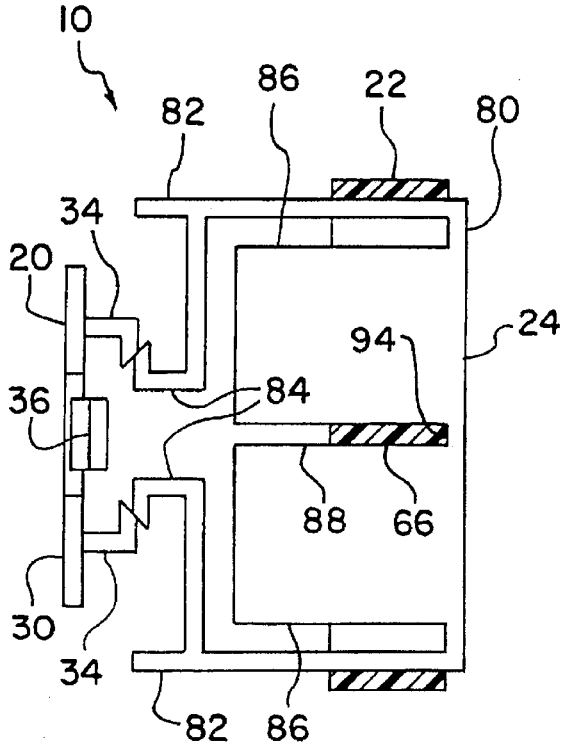
FIGS. 23–30 are sequential elevational views of the infant safety latch mechanism illustrated in FIGS. 1–10 with the mounting guide shown in cross-section for illustrating the sequential coupling of the clip to the cleat.

Referring to particularly to FIGS. 11–13, cleat 20 is illustrated, and includes a base or mounting plate 30 with a pair of mounting holes 32, a pair of latching elements 34 extending from mounting plate 30 and a safety tab 36 also extending from mounting plate 30. As mentioned above, preferably cleat 20 is constructed as a one-piece, unitary member out of a plastic material. Cleat 20 can be mounted to door or movable member 16 by a pair of screws (not shown) or by a conventional adhesive of sufficient strength such that an infant or young child could not break the adhesive to disable latch mechanism 10.

Latching elements 34 extend outwardly from the flat mounting plate 30 and are preferably L-shaped members. Latching elements 34 are spaced from each other by a predetermined distance to allow a portion of clip 24 to enter therebetween for latching cleat 20 to clip 24. Each of the latching elements 34 has a first latch portion 40 extending substantially perpendicularly from mounting plate 30 and a second latch portion 42 extending substantially parallel to mounting plate 30. Preferably, second portions 42 of each of the latching elements 34 extend towards each other such that latching elements 34 and 36 are substantially mirror images of each other about a horizontal center plane of mounting plate 30. Each of the second portions 42 of latching elements 34 has a latching surface 44 and a ramping surface 46. Latching surfaces 44 are designed to engage clip 24 as discussed below to releasably couple cleat 20 to clip 24. Ramping surfaces 46 are designed to permit automatic coupling of cleat 20 to clip 24 upon closing the door or movable member 16 relative to the cabinet or fixed member 14 of enclosure 12 as discussed below.

Safety tab 36 is positioned between latching elements 34 so as to provide an added measure of safety to latch mechanism 10. In particular, safety tab 36 is integrally coupled to mounting plate 30 by a living hinge 50 located between latching elements 34. Safety tab 36 can be initially formed to extend outwardly from mounting plate 30 at an angle so that the free end of safety tab 36 is located close to second latch portions 42 of latching elements 34 to prevent inadvertent uncoupling of the clip 24 from cleat 20. Alternatively, safety tab 36 can be made to initially lie in the same plane as base 30, and then subsequently permanently deformed or modified by deflecting or bending safety tab 36 outwardly, until safety tab 36 permanently yields to an angulated position adjacent to second portions 42 of latching elements 34.

In either case, when safety tab 36 is in its angulated position and clip 24 is coupled to cleat 20, clip 24 cannot be unlatched from cleat 20 without applying pressure to safety tab 36 to move it out of the way of clip 24 as discussed in more detail below. In this angulated position, living hinge 50 allows for resilient movement of safety tab 36 relative to mounting plate 30 and latching elements 34. In particular, safety tab 36 can be moved from its angulated position to a second position wherein safety tab 36 lies substantially in the same plane of mounting plate 30 for permitting clip 24 to be unlatched from cleat 20. Upon releasing pressure from safety tab 36, safety tab 36 will spring back to its original angulated position.

Referring now to FIGS. 15–18, mounting guide 22 is illustrated as an integrally formed one-piece, unitary member constructed of a plastic material. Mounting guide 22 has a tubular body portion 60 for slidably receiving clip 24 therein, and a mounting plate or flange 62 with a pair of mounting holes 64 formed therein for fixedly coupling guide 22 to cabinet or fixed member 14 of enclosure 12 via a pair of screws (not shown) or a strong adhesive.

It will be apparent to those skilled in the art from this disclosure that mounting plate 62 of mounting guide 22 could be eliminated if desired, and replaced with other mounting structures. For example, mounting guide 22 could be directly screwed or adhesively attached to cabinet or fixed member 14 without the need of the additional mounting plate 62. However, mounting plate 62 is preferably designed for holding mounting guide 22 at the correct location on the cabinet. For example, in a conventional wood kitchen cabinet, mounting plate 62 will hold mounting guide 22 so that the front edge of mounting guide 22 is substantially flush or slightly recessed from the front surface of the cabinet to ensure correct positioning thereon.

Body portion 60 preferably includes a guide web 66 dividing the tubular body portion 60 into two substantially equally sized guide cavities 68. Preferably, guide cavities 68 are substantially rectangular bores designed to slidably receive portions of clip 24 therein as discussed hereinafter.

Tubular body portion 60 also preferably includes an integrally molded guide catch 70 for coupling clip 24 to mounting guide 22 for a limited predetermined range of movement. Preferably, guide catch 70 is formed on the opposite side of body portion 60. Guide catch 70 has an arm portion 72 extending parallel to the longitudinal axis of guide cavities 68 and a rib portion 74 extending inwardly into one of the guide cavities 68 from the free end of arm portion 72. Arm portion 72 is resiliently coupled to tubular body portion 60 so that rib portion 74 can be resiliently deflected out of upper guide cavity 68. This permits clip 24 to be either coupled to mounting guide 22, removed from mounting guide 22, or placed in the "null" position as discussed hereinafter. As particularly seen in FIGS. 16 and 18, the resiliency of arm portion of guide catch 70 is due to the reduced thickness of arm portion 72 relative to the remainder of mounting guide 22. In particular, arm portion 72 is approximately half the thickness of the wall of tubular body portion 60 such that tubular body portion 60 is substantially rigid and inflexible, while guide catch 60 is resiliently movable relative to body portion 60 via arm portion 72.

Turning now to FIGS. 19–22, clip 24 is illustrated as being an integrally formed, one-piece, unitary member out of a plastic material. Clip 24 includes a substantially rectangular body portion 80, a pair of release arms 82 extending from opposite ends of body portion 80 and a pair of hook-shaped latching elements 84 extending inwardly towards each other from release arm 82. As mentioned above, clip 24 is slidably mounted within guide 22 and releasably coupled to cleat 20 for selectively locking enclosure 12.

Body portion 80 is divided into a pair of block members 86 by a guide slot 88. Block members 86 are designed to be received within guide cavities 68 of mounting guide 22 with guide web 66 of mounting guide 22 being received in guide slot 88 of body portion 80. The upper block member 86 as seen in FIGS. 19–22, has a guide catch slot 90 formed in one of its surfaces for slidably receiving guide catch 70 therein. In particular, guide catch slot 90 is opened at its rearward end of body portion 80, while spaced from the forward end of body portion 80. Accordingly, guide catch slot 90 has a stop surface 92 for engaging rib portion 74 of guide catch 70. Rib portion 74 of guide catch 70 cooperates with stop surface 92 of guide catch slot 90 for limiting the rearward movement of clip 24 relative to mounting guide 22. Forward movement of clip 24 relative to mounting guide 22 is limited by a stop surface 94 formed in guide web slot 88. In particular, stop surface 94 of guide web slot 88 engages the rear surface of guide web 66 to limit the forward movement of body portion 80 within guide cavities 68 of mounting guide 22.

Accordingly, clip 24 is restrained between stop surfaces 92 and 94 such that clip 24 is slidably coupled to mounting guide 22 through a predetermined range of movement. This predetermined range of movement is sufficient to allow the door or movable member 16 of enclosure 12 to pivot slightly for permitting access to latch mechanism 10, but yet limited to prevent the door or movable member 16 from opening too far to allow a child or infant to access the products stored within enclosure 12.

Release arms 82 are integrally formed at the top and bottom rearward corners of body portion 80 and extend forwardly to form a pair of lever arms resiliently coupled to body portion 80. In other words, the release arms 82 are spaced from the upper edges of body portions 80 to allow inward movement of release arms 82 towards each other upon applying an inwardly squeezing force thereon. Due to the plastic material of clip 24 and the cantilever arrangement of release arms 82, release arms 82 are permitted to resiliently deflect inwardly upon applying such inward pressure, and then spring back to its original rest state upon release of such inwardly extending pressure therein.

Each of the latching elements 84 includes a connecting member 96 extending perpendicularly inwardly from its respective release arm 82, a first latch portion 98 extending perpendicular from its connecting member 96 and a second latch portion 100 extending from its first latch portion 98 in a direction substantially parallel to its connecting member 96.

Connecting members 96 are preferably spaced inwardly from the free ends of release arms 82 such that latching elements 84 do not extend farther out than release arms 82. First latch portion 98 and second latch portion 100 are substantially identical to first latch portion 40 and second latch portion 42 of latching elements 34, except that they are spaced closer together and facing the opposite directions. In other words, latch portions 98 are substantially parallel to each other, while latch portions 100 extend from the free ends of latch portions 98 outwardly relative to each other. Latch portions 100 each include a latching surface 102 for engaging a respective latching surface 44 of one of the latching elements 34 and a ramping surface 104 for engaging a respective ramping surface 46 of one of the latching elements 34.

As seen in FIGS. 23–26, latch portions 98 and 100 of latching elements 84 are spaced apart from each other a predetermined distance such that when cleat 20 and clip 24 are brought together, ramping surfaces 46 of latching elements 34 engage ramping surfaces 104 of latching elements 84 to cause latching elements 84 to deflect inwardly towards each other due to the resiliency of release arms 82. This initial inward deflection of latching elements 84 continues as ramping surfaces 104 ride along ramping surfaces 46 of latching elements 34.

Also, as ramping surfaces 104 ride along ramping surfaces 46, latch portions 100 engage safety tab 36 to deflect safety tab 36 towards mounting plate 30. This deflection of safety tab 36 allows latch portion 100 to continue to move between latching elements 34 sufficiently so that latching elements 84 can spring outwardly due to the resilience of release arms 82. In other words, once ramping surfaces 104 reach the end of ramping surfaces 46, latching elements 84 spring outwardly due to the resiliency of release arms 82 such that latching surfaces 102 are now engaged with latching surfaces 44 of cleat 20.

In this position, clip 24 is fixedly coupled to cleat 20 such that cleat 20 and clip 24 move together. Of course, this movement is limited by mounting guide 22 as mentioned above. Also, in this position, safety tab 36 has its free end positioned between latch portions 100 of latching elements 84 such that inwardly deflection of release arms 82 will cause latch portions 100 to hit safety tab 36 to prevent sufficient deflection of latching elements 84 to disengage from latching elements 34. Of course, if safety tab 36 is pressed towards mounting plate 30, then the release arms 82 can be squeezed together to cause latching elements 84 to release from latching elements 34.

Assembly and Operation

Referring initially to FIGS. 1–6, latch mechanism 10 is normally hidden from the user's view when the door or movable member 16 of enclosure 12 is in its closed position. Initially, the user may only open the door or movable member 16 of enclosure 12 to approximately 1.25 inches due to the sliding arrangement of clip 24 in mounting guide 22.

Latch mechanism 10 is installed on enclosure 12, by first securing either cleat 20 or mounting guide 22 to enclosure 12. In particular, cleat 20 is secured to door or movable member 16 via screws or adhesive, while mounting guide 22 is secured to the interior surface of the cabinet or fixed member 14 via screws or adhesive. Of course, as mentioned above, depending upon what the enclosure is, i.e., whether it is a pivoting door, sliding door or a drawer, it may be possible for cleat 20 to be secured to the fixed member and mounting guide 22 to be secured to the movable member.

In any event, referring again to the illustrations, once cleat 20 and mounting guide 22 are mounted in place, clip 24 is now coupled to mounting guide 22 by deflecting guide catch 70 outwardly out of upper guide cavity 68 such that clip 24 can now slide within guide cavities 68 of mounting guide 22. Next, the guide catch 70 is released to position rib portion 74 of guide catch 70 within guide catch slot 90 so that clip 24 is secured to mounting guide 22 for limited sliding movement. Of course, it is possible to install mounting guide 22 to the enclosure 12 with the clip 24 already installed thereon.

Figure 24:
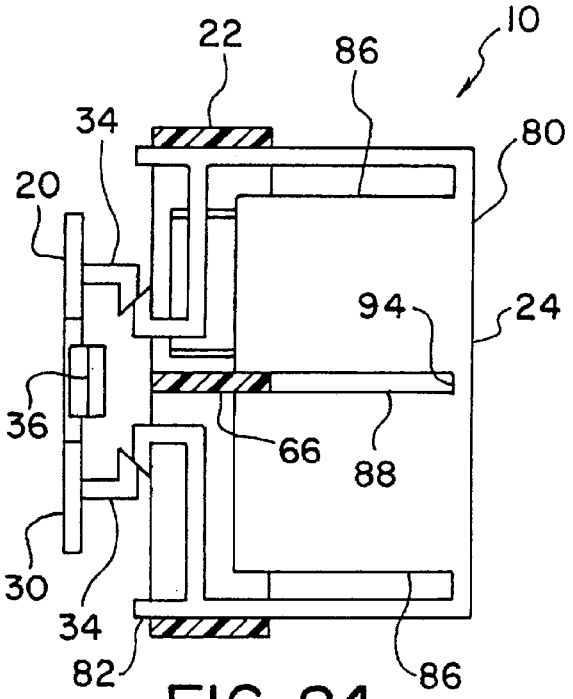
Figure 25:
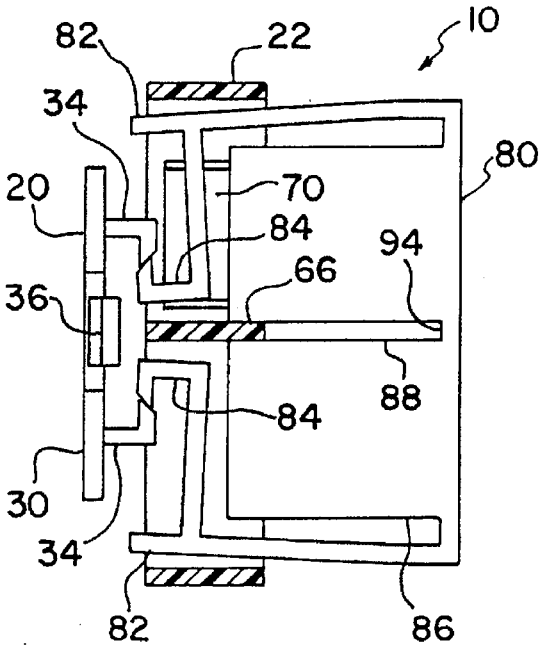
Figure 26:
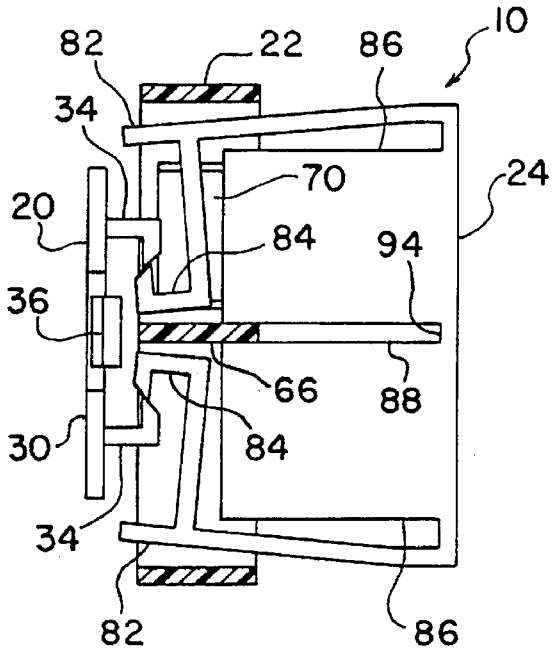
Figure 27:
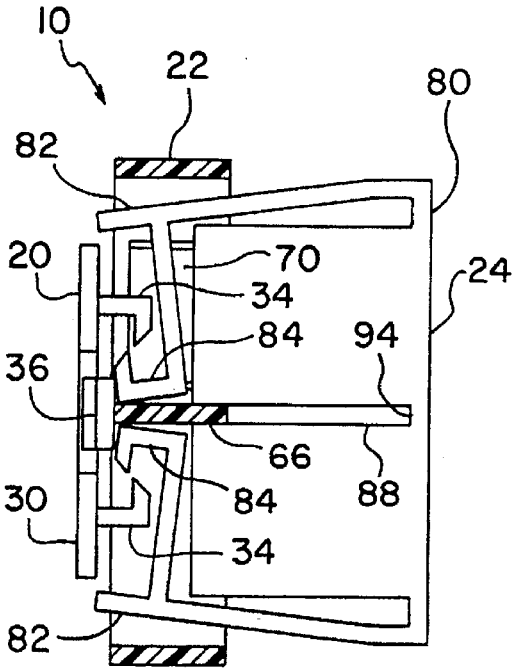
Figure 28:
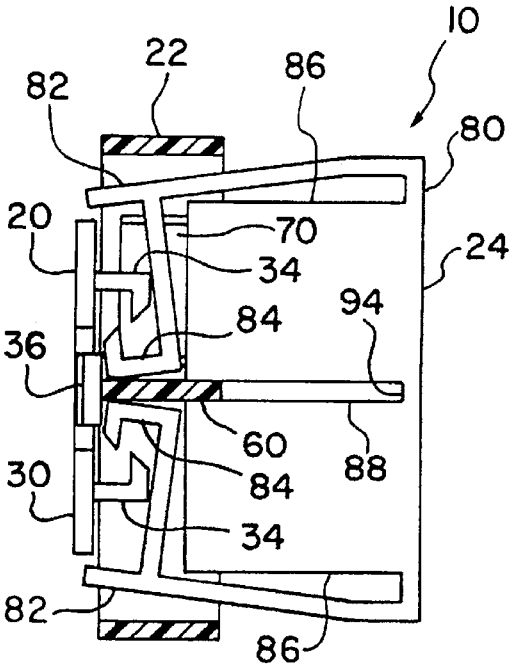
Figure 29:
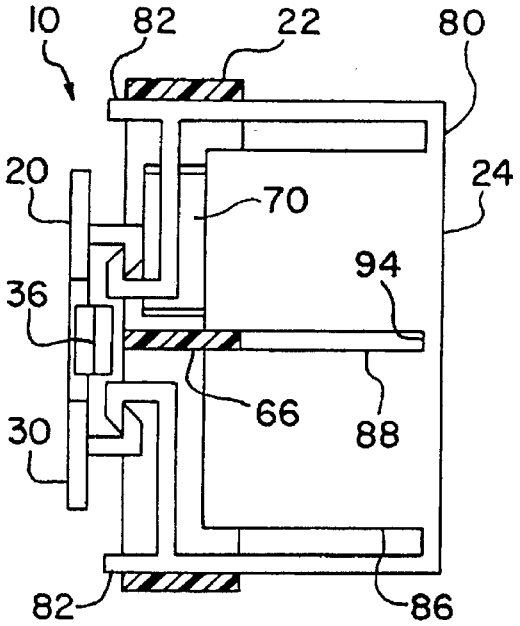
Figure 30:
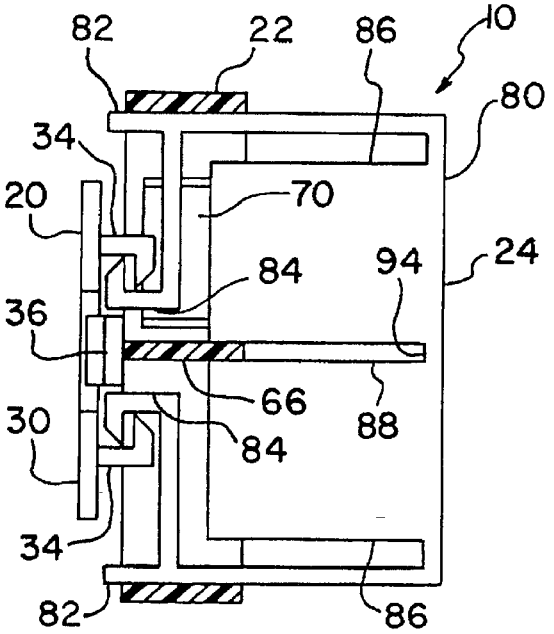
Figure 31:
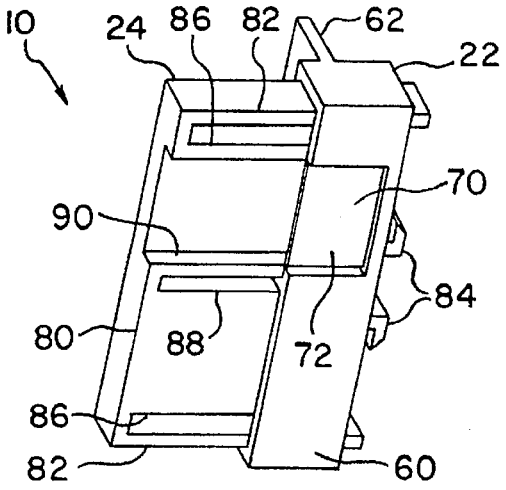
FIGS. 31–33 are sequential perspective views of the infant safety latch mechanism illustrated in FIGS. 1–10 which illustrate moving the clip from its latching position to a null position such that the clip cannot latch with the cleat.
Figure 34:
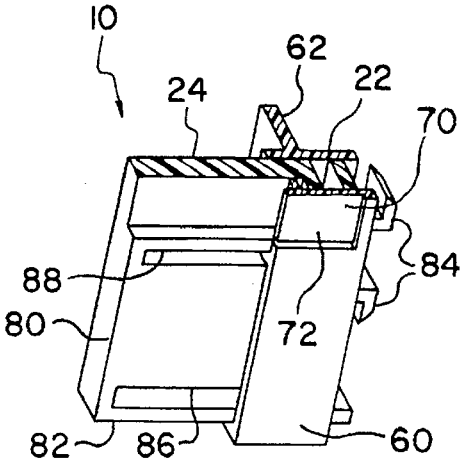
FIGS. 34–36 are partial, sequential perspective views of the infant safety latch mechanism illustrated in FIGS. 31–33 with portions broken away to illustrate the cooperation and the movement of the guide catch relative to the clip for moving the clip from its latching position to its null position.
Figure 32:
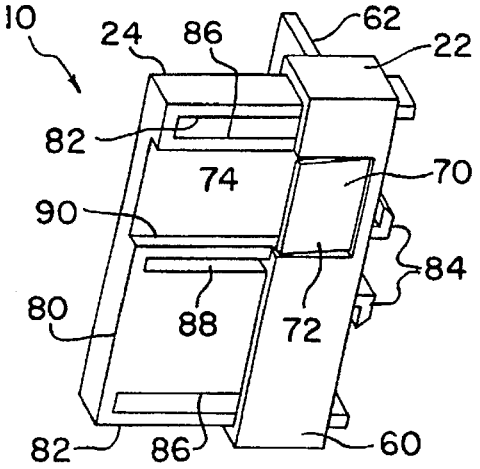
Figure 35:
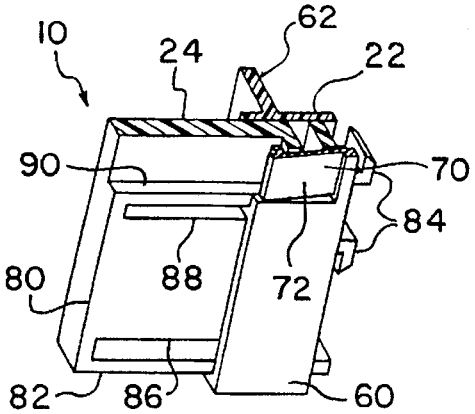
Figure 33:
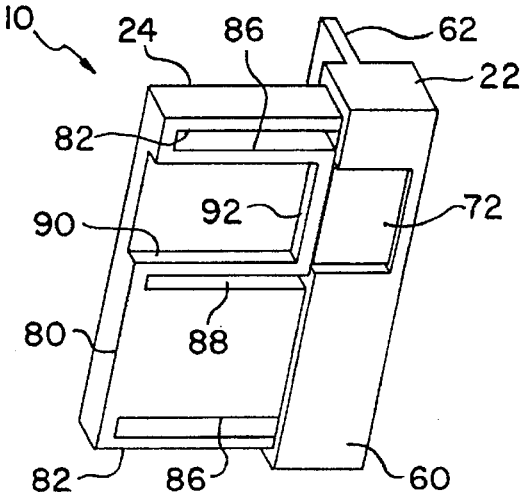
Figure 36:
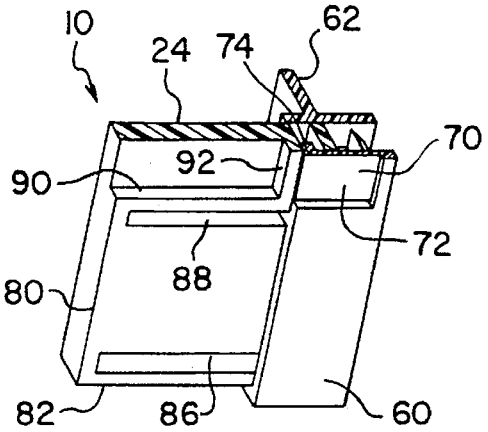

Now that latch mechanism 10 is assembled onto enclosure 12, the user merely needs to close the door or movable member 16 to cause cleat 20 to be coupled to clip 24 automatically. This is particularly illustrated in FIGS. 23–30. More specifically, as the door or movable member 16 is pivoted closed, latching elements 34 of cleat 20 engages latching elements 84 of clip 20 to cause clip 24 to slide rearwardly within mounting guide 22 to its rearmost position such that rib portion 74 of guide catch 70 engages stop surface 92 of guide catch slot 90 as seen in FIG. 24. Further movement of door or movable member 16 causes ramping surfaces 104 of latching elements 84 to ride along ramping surfaces 46 of cleat 20. This causes latching elements 84 to be resiliently deflected inwardly against the spring force of release arms 82. As latching elements 84 continue to ride along ramping surfaces 46 of latching elements 34, latch portions 100 of latching elements 84 press safety latch 36 towards its mounting plate 30 so that latching elements 84 can engage latching elements 34.

Once ramping surfaces 104 has completely ridden over ramping surfaces 46, latching elements 84 spring outwardly due to the resiliency of the spring force of release arms 82 causing latching surfaces 102 to engage latching surfaces 44. In this position, cleat 20 and clip 24 are now secured together. Now, the door or movable member 16 can only be opened approximately 1.25 inches due to the sliding arrangement of clip 24 within guide 22.

To open the movable door or movable member 16 of enclosure 12, the user must pull the door or movable member 16 approximately 1.25 inches to access latch mechanism 10. This is the maximum opening allowed by latch mechanism 10 when clip 24 is engaged with cleat 20 in their latched position. The user can then release the exposed latched mechanism 10 by pressing or deflecting release arms 82 of clip 24 inwardly towards each other with the force from the user's finger and thumb, until the latching elements 84 disengage from latching elements 34. Of course, if safety tab 36 is being utilized, safety tab 36 must first be depressed towards mounting plate 30 so that safety tab 36 no longer blocks the inward movement of latching elements 84. The latch mechanism 10 is now disengaged and the door or movable member 16 can be fully opened.

A further feature of the latch mechanism 10 of the present invention is that it can be placed in a null operating condition or position such that clip 24 will not normally engage 20 during normal operation, and yet latch mechanism 10 does not have to be removed from enclosure 12. In particular, as seen in FIGS. 31–36, guide catch 70 is designed to be received within the space between body portion 80 and connecting members 96 of latch elements 84 such that rib portion 74 is located in this space to lock clip 24 within mounting guide 22 so that latching elements 84 can no longer engage latching elements 34.

More specifically, clip 24 can be placed in the null position by first lifting guide catch 70 and then pushing clip 24 rearwardly until the rib portion 74 falls in the space between connecting member 96 and body portion 80. Of course, the clip 24 could be entirely removed by continuing to hold the guide catch 70 out of the path of the clip and continue sliding clip 24 completely through mounting guide 22, if desired. The latch mechanism 10 can be reactivated from its null position by reversing the above steps.

Latch mechanism 10, as illustrated in the drawings and as previously disclosed herein, is not designed as necessarily the primary latch. In other words, latch mechanism 10 can be used in conjunction with other conventional latches such as conventional spring latches. Of course, many kitchen cabinets have spring hinges for holding the door shut such that additional latches are not necessary. Moreover, it would be apparent to those skilled in the art from this disclosure that latch mechanism 10 can be easily modified to provide the dual function of a conventional spring latch as well as a safety latch. In particular, the guide cavities 68 could be provided with one or more recesses, while release arms 82 could be provided with protrusions or detents which engage these recesses of guide cavities 68 to provide a snap-fit therebetween. This snap-fit could be utilized to hold the door in its closed position.

While only one embodiment has been chosen to illustrate the invention, it will be understood by those skilled in the art that various changes and modifications can be made herein without departing from the scope of the invention as defined in the appended claims.

What is claimed is:

1. An infant safety latch mechanism adapted to be mounted within an enclosure for securing a movable member of the enclosure to a fixed member of the enclosurer, said latch mechanism comprising:

a cleat having a base adapted to be mounted to an interior surface of one of the members of the enclosure, and a pair of first spaced latching elements coupled to said base;

a mounting guide adapted to be coupled to an interior surface of the other member of the enclosure; and a clip having a body portion movably coupled to said guide for limited movement within a predetermined range of movement, and a pair of second spaced latching elements coupled to said body portion for engaging said first latching elements to releasably couple said cleat and said clip together so that said cleat and said clip can move together relative to said guide when in a latched position, two of said latching elements being normally biased to said latched position for releasably coupling said first latching elements to said second latching elements, said second latching elements being movably coupled to said body portion of said clip, each of said second latching elements having a release arm resiliently coupled to said body portion of said clip for allowing relative movement of said second latching elements, said guide including a first guide cavity for slidably receiving said body portion of said clip therein, said guide further including a catch for engaging a first slot formed in said clip to prevent accidental separation of said clip from said guide and to at least partially control said predetermined range of movement, each of said first and second latching elements including a ramping surface for cooperating with each other upon closing the movable member against the fixed member to automatically bias said second latching elements initially inwardly toward each other until said first and second latching elements reach said latched position where said second latching elements spring outwardly to latch said clip to said cleat.

2. An infant safety latch mechanism according to claim 1, wherein said cleat further includes a safety tab movably coupled to said base and positioned between said first latching elements to prevent disengagement of said second latching elements from said first latching elements until said tab is moved away from said second latching elements.

3. An infant safety latch mechanism according to claim 2, wherein said clip having a second slot for selectively engaging said catch of said guide to maintain said second latching elements in a null position so that said first latching elements cannot be coupled to said second latching elements.

4. An infant safety latch mechanism adapted to be mounted within an enclosure for securing a movable member of the enclosure to a fixed member of the enclosure, said latch mechanism comprising:

a cleat having a base adapted to be mounted to an interior surface of one of the members of the enclosure, and a pair of first spaced latching elements coupled to said base;

a mounting guide adapted to be coupled to an interior surface of the other member of the enclosure; and a clip having a body portion movably coupled to said guide for limited movement within a predetermined range of movement, and a pair of second spaced latching elements coupled to said body portion for engaging said first latching elements to releasably couple said cleat and said clip together so that said cleat and said clip can move together relative to said guide when in a latched position, two of said latching elements being normally biased to said latched position for releasably coupling said first latching elements to said second latching elements, said cleat further including a safety tab movably coupled to said base and positioned between said first latching elements to prevent disengagement of said second latching elements from said first latching elements until said tab is moved away from said second latching elements.

5. An infant safety latch mechanism adapted to be mounted within an enclosure for securing a movable member of the enclosure to a fixed member of the enclosure, said latch mechanism comprising:

a cleat having a base adapted to be mounted to an interior surface of one of the members of the enclosure, and a pair of first spaced latching elements coupled to said base;

a mounting guide adapted to be coupled to an interior surface of the other member of the enclosure; and a clip having a body portion movably coupled to said guide for limited movement within a predetermined range of movement, and a pair of second spaced latching elements coupled to said body portion for engaging said first latching elements to releasably couple said cleat and said clip together so that said cleat and said clip can move together relative to said guide when in a latched position, two of said latching elements being normally biased to said latched position for releasably coupling said first latching elements to said second latching elements, said guide further including a catch for engaging a first slot formed in said clip to prevent accidental separation of said clip from said guide and to at least partially control said predetermined range of movement, said clip having a second slot for selectively engaging said catch of said guide to maintain said second latching elements in a null position so that said first latching elements cannot be coupled to said second latching elements.

6. An infant safety latch mechanism adapted to be mounted completely within an enclosure for securing a movable member of the enclosure to a fixed member of the enclosure, said latch mechanism comprising:

a cleat having a base adapted to be mounted to an interior surface of one of the members of the enclosure, and a pair of first spaced latching elements integrally formed with said base as a one-piece, unitary member;

a mounting guide adapted to be mounted to an interior surface of the other member of the enclosure, said guide having a catch resiliently coupled thereto; and a clip having a body portion with a pair of second spaced latching elements movably coupled thereto for releasably engaging said first latching elements to couple said cleat and said clip together in a latched position, said body portion being slidably coupled to said guide by said catch for limited sliding movement in said latched position for allowing limited movement of the members of the enclosure in said latched position to access said second latching elements.

7. An infant safety latch mechanism according to claim 6, wherein said cleat, said mounting guide and said clip are each constructed of a substantially rigid, hard plastic material.

8. An infant safety latch mechanism according to claim 7, wherein each of said second latching elements has a release arm resiliently coupled to said body portion of said clip for allowing relative movement of said second latching elements.

9. An infant safety latch mechanism according to claim 8, wherein each of said first and second latching elements includes a ramping surface for cooperating with each other upon closing the movable member against the fixed member to automatically bias said second latching elements initially inwardly toward each other until said first and second latching elements reach said latched position where said second latching elements spring outwardly to latch said clip to said cleat.

10. An infant safety latch mechanism according to claim 6, wherein said cleat further includes a safety tab movably coupled to said base and positioned between said first latching elements to prevent disengagement of said second latching elements from said first latching elements until said tab is moved away from said second latching elements.

11. An infant safety latch mechanism according to claim 6, wherein said body portion of said clip has a first longitudinally extending slot for engaging said catch of said guide, and a pair of stop surfaces for controlling the sliding movement of said clip relative to said guide.

12. An infant safety latch mechanism according to claim 11, wherein said clip having a second slot for selectively engaging said catch of said guide to maintain said second latching elements in a null position so that said first latching elements cannot be coupled to said second latching elements.

* * * * *